US012709901B2

(12) United States Patent
Meijer

(10) Patent No.: US 12,709,901 B2
(45) Date of Patent: Aug. 18, 2026

(54) BUILDING PANEL WITH A MECHANICAL LOCKING SYSTEM

(71) Applicant: Välinge Innovation AB, Viken (SE)

(72) Inventor: Thomas Meijer, Viken (SE)

(73) Assignee: VÄLINGE INNOVATION AB, Viken (SE)

( * ) Notice: Subject to any disclaimer, the term of this patent is extended or adjusted under 35 U.S.C. 154(b) by 186 days.

(21) Appl. No.: 18/440,330

(22) Filed: Feb. 13, 2024

(65) Prior Publication Data

US 2024/0271429 A1 Aug. 15, 2024

(30) Foreign Application Priority Data

Feb. 14, 2023 (SE) ..... 2350139-8

(51) Int. Cl.
*E04F 15/02* (2006.01)
*A47B 47/00* (2006.01)
(Continued)

(52) U.S. Cl.
CPC .... *E04F 15/02038* (2013.01); *A47B 47/0075* (2013.01); *A47B 96/201* (2013.01); *E04F 13/0894* (2013.01); *A47B 2230/16* (2013.01); *E04F 2201/023* (2013.01); *E04F 2201/049* (2013.01)

(58) Field of Classification Search
CPC . E04F 15/00; E04F 15/02038; E04F 13/0894; E04F 2201/023; E04F 2201/049; E04F 2201/05; A47B 47/0075; A47B 96/201; A47B 2230/16
See application file for complete search history.

(56) References Cited

U.S. PATENT DOCUMENTS 11,060,302 B2 * 7/2021 Ylikangas ..... E04C 2/40
11,406,184 B2 * 8/2022 Hove ..... E04F 11/09
(Continued)

FOREIGN PATENT DOCUMENTS

CH 703317 B1 12/2011
EP 2063044 A1 5/2009
(Continued)

OTHER PUBLICATIONS

U.S. Appl. No. 18/766,880, Thomas Meijer, filed Jul. 9, 2024.
(Continued)

*Primary Examiner* — Chi Q Nguyen
(74) *Attorney, Agent, or Firm* — Boone IP Law

(57) ABSTRACT

A set of panels configured to be locked together by a flexible tongue which includes a flexible element and an opposite flexible element, wherein an end of the flexible element and an end of the opposite flexible element are connected to a connecting part, wherein an outer end of the flexible element and an outer end of the opposite flexible element each includes a protruding part, wherein the protruding part of the flexible element and the protruding part of the opposite flexible element are configured to cooperate during assembling of the first panel and the second panel with a guiding surface of the first panel such that the protruding part of the flexible element and the protruding part of the opposite flexible element are pushed towards a bottom surface of the insertion groove.

16 Claims, 6 Drawing Sheets

(51) Int. Cl.
*A47B 96/20* (2006.01)
*E04F 13/08* (2006.01)

(56) References Cited

U.S. PATENT DOCUMENTS

| | | | | |
|---|---|---|---|---|
| 11,987,992 | B2 * | 5/2024 | Boo | E04F 13/0894 |
| 12,326,003 | B2 * | 6/2025 | Ylikangas | B27G 13/14 |
| 2007/0028547 | A1 | 2/2007 | Grafenauer | |
| 2009/0308014 | A1 | 12/2009 | Muehlebach | |
| 2013/0042564 | A1 * | 2/2013 | Pervan | E04F 15/02038 52/582.2 |
| 2013/0263547 | A1 * | 10/2013 | Boo | E04F 13/076 52/588.1 |
| 2016/0090744 | A1 | 3/2016 | Pervan | |
| 2017/0089379 | A1 * | 3/2017 | Pervan | A47B 47/0075 |
| 2018/0001510 | A1 * | 1/2018 | Fransson | B27G 13/08 |
| 2019/0323533 | A1 | 10/2019 | Boo | |
| 2019/0323534 | A1 | 10/2019 | Derelöv | |
| 2023/0235571 | A1 * | 7/2023 | Larsson | E04F 15/02038 52/586.1 |

FOREIGN PATENT DOCUMENTS

WO 2008060232 A1 5/2008
WO 2019203720 A1 10/2019

OTHER PUBLICATIONS

U.S. Appl. No. 19/068,325, Oscar Rydsjö, filed Mar. 3, 2025.
Official Action from the Swedish Patent and Registration Office in corresponding Swedish Application No. 2350139-8, dated Oct. 5, 2023, 12 pages.
U.S. Appl. No. 17/398,416, Thomas Meijer, filed Aug. 10, 2021.
U.S. Appl. No. 17/514,055, Marko Sostar, filed Oct. 29, 2021.
U.S. Appl. No. 17/665,160, Oscar Rydsjö, filed Feb. 4, 2022.
U.S. Appl. No. 17/784,341, Johan Svensson, filed Jun. 10, 2022.
U.S. Appl. No. 17/847,655, Thomas Meijer, filed Jun. 23, 2022.
U.S. Appl. No. 17/870,215, Peter Derelöv, filed Jul. 21, 2022.
U.S. Appl. No. 17/959,010, Mindaugas Zacharenko, filed Oct. 3, 2022.
U.S. Appl. No. 18/058,037, Peter Derelöv, filed Nov. 22, 2022.
U.S. Appl. No. 18/191,404, Thomas Meijer, filed Mar. 28, 2023.
U.S. Appl. No. 18/239,924, Niclas Håkansson, filed Aug. 30, 2023.
U.S. Appl. No. 18/422,368, Christian Boo, filed Jan. 25, 2024.
U.S. Appl. No. 18/422,425, Christian Boo, filed Jan. 25, 2024.
U.S. Appl. No. 18/441,480, Peter Derelöv, filed Feb. 14, 2024.
U.S. Appl. No. 18/271,460, Peter Derelöv, filed Jul. 9, 2023.
U.S. Appl. No. 19/048,028, Oscar Rydsjö, Feb. 7, 2025.
U.S. Appl. No. 19/226,620, Henrik Lindquist, filed Jun. 3, 2025.

* cited by examiner

BUILDING PANEL WITH A MECHANICAL LOCKING SYSTEM

CROSS REFERENCE TO RELATED APPLICATIONS

The present application claims the benefit of Swedish Application No. 2350139-8, filed on Feb. 14, 2024. The entire contents of Swedish Application No. 2350139-8 are hereby incorporated herein by reference in their entirety.

TECHNICAL FIELD OF THE INVENTION

Embodiments of the present invention relate to panels, such as a building panels, floorboards, wall panels, ceiling panels, furniture components or the like, which comprise a mechanical locking system.

TECHNICAL BACKGROUND

Building panels provided with a mechanical locking system comprising a displaceable and resilient tongue cooperating with a tongue groove for locking is known and disclosed in, e.g., WO2019/203720. The tongue is a separate part and is made of, e.g., plastic and inserted in a displacement groove at an edge of a panel. The tongue is pushed into the displacement groove during assembling of the panels and springs back into the tongue groove of an adjacent panel when the panels have reached a locked position.

A drawback with the known mechanical systems is the length of the tongue required to achieve a certain spring force and certain spring travel without a rupture of the tongue.

The above description of various known aspects is the applicant's characterization of such, and is not an admission that any of the above description is considered as prior art.

SUMMARY OF THE INVENTION

It is an object of certain embodiments of the present invention to provide an improvement over the above described techniques and known art. An advantage of the tongue according to the invention and a set of panels according to the invention which includes the tongue may be that the required spring force is obtained for a specified compression distance or rate of the tongue while the size of the tongue is maintained or reduced. The required locking force may be obtained by a small sized tongue.

A tongue of a small size may be an advantage when assembling and locking together objects, such as panels of a relatively small size.

Moreover, the tongue according to the invention may be configured such that the maximum stress in the tongue at a specified compression distance is reduced.

Moreover, the tongue according to the invention may be configured such that a compression force applied on the tongue during the compression is distributed over a high proportion of the material in the tongue. This may have the advantage that the highest stress in the tongue during compression is relatively low.

Moreover, the tongue according to the invention may be configured such that a progressive spring force is obtained which may facilitate assembling and locking together objects, such as panels.

A tongue of a small size may be an advantage when assembling and locking together objects, such as panels of a relatively small size.

At least some of these and other objects and advantages that will be apparent from the description have been achieved by a first aspect of the invention that comprises set of panels, such as building panels, which comprises a first panel with a first edge and a second panel with a second edge and a flexible tongue. The second edge comprises an insertion groove comprising the flexible tongue and the first edge comprises a tongue groove. The flexible tongue is configured to cooperate in an assembled state of the first panel and the second panel with the tongue groove.

The flexible tongue comprises a flexible element and an opposite flexible element, wherein an end of the flexible element and an end of the opposite flexible element are connected to a connecting part. An outer end of the flexible element and an outer end of the opposite flexible element each comprises a protruding part.

The protruding part of the flexible element and the protruding part of the opposite flexible element are configured to cooperate during assembling of the first panel and the second panel with a guiding surface of the first panel such that the protruding part of the flexible element and the protruding part of the opposite flexible element are pushed towards a bottom surface of the insertion groove.

The protruding part of the flexible element and the protruding part of the opposite flexible element are configured to cooperate in the assembled state with the tongue groove.

The flexible element and the opposite flexible element may be configured to bend during the assembling.

The protruding part of the flexible element and the protruding part of the opposite flexible element may before the assembling protrude outside the insertion groove.

The flexible tongue may comprise an inner flexible element and an opposite inner flexible element, wherein an end of the inner flexible element and an end of the opposite inner flexible element may be connected to the connecting part.

The inner flexible element may have a lower spring constant than the flexible element.

The opposite inner flexible element may have a lower spring constant than the opposite flexible element.

The inner flexible element, opposite inner flexible element and the connecting part may be configured to be positioned within the insertion groove.

An outer end of the inner flexible element, and an outer end of the opposite inner flexible element may each comprise a protruding part which may be configured to cooperate during the assembling with a bottom surface of the insertion groove.

The flexible tongue my comprise a space between the flexible element and the inner flexible element, and an opposite space between the opposite flexible element and the opposite inner flexible element.

the flexible element and the inner flexible element may be configured to bend towards each other during the assembling, and the opposite flexible element and the opposite inner flexible element may be configured to bend towards each other, optionally such that the space and the opposite space decreases.

A longitudinal direction of the tongue may be essentially parallel with a longitudinal direction of the insertion groove.

The flexible tongue may have a symmetrical shape with a symmetry line through the connecting part.

The flexible tongue may be injection moulded. Thus, the entire flexible tongue may be made from the same material.

The flexible tongue may comprise a polymer material, such as a thermoplastic material, optionally with an enforcement, such as glass fibre.

A second aspect of the invention is a flexible tongue which is configured to lock a first edge of a first panel to a second edge of a second panel. The flexible tongue is configured to be positioned in an insertion groove at the second edge of the second panel and to cooperate with a tongue groove at the first edge of the first panel.

The flexible tongue comprises a flexible element and an opposite flexible element, wherein an end of the flexible element and an end of the opposite flexible element are connected to a connecting part, wherein an outer end of the flexible element and an outer end of the opposite flexible element each comprises a protruding part.

The flexible tongue comprises an inner flexible element and an opposite inner flexible element, wherein an end of the inner flexible element and an end of the opposite inner flexible element are connected to the connecting part, wherein an outer end of the inner flexible element, and an outer end of the opposite inner flexible element each comprises a protruding part which are during the assembling configured to cooperate with a bottom surface of the insertion groove.

The flexible element and the inner flexible element are configured to bend towards each other when a force is applied against the protruding part of the flexible element.

The opposite flexible element and the opposite inner flexible element are configured to bend towards each other when a force is applied against the protruding part of the opposite flexible element, such that the flexible tongue is compressed against a bottom surface of the insertion groove.

The protruding part of the flexible element and the protruding part of the opposite flexible element may be configured to protrude outside the insertion groove before the flexible element is compressed.

The inner flexible element, the opposite inner flexible element and the connecting part may be configured to be positioned within the insertion groove.

The protruding part of the inner flexible element and the protruding part of the opposite inner flexible element may be configured to cooperate during the compression with a bottom surface of the insertion groove.

The protruding part of the flexible element and the protruding part of the opposite flexible element may be configured to cooperate in the assembled state with the tongue groove.

The flexible tongue may comprise a space between the flexible element and the inner flexible element, and an opposite space between the opposite flexible element and the opposite inner flexible element.

The flexible tongue may be configured such that during the compression the space and the opposite space decreases.

A longitudinal direction of the tongue may be essentially parallel with a longitudinal direction of the insertion groove.

The flexible tongue may have a symmetrical shape with a symmetry line through the connecting part.

The flexible tongue may be of an elongated shape with a length in a longitudinal direction.

The length of the flexible tongue may be in a range of about 20 mm to about 70 mm, such as about 30 mm to about 50 mm, such as about 40 mm.

A third aspect is a flexible tongue which is configured to lock a first edge of a first panel to a second edge of a second panel. The flexible tongue is configured to be positioned in an insertion groove at the second edge of the second panel and to cooperate with a tongue groove at the first edge of the first panel, wherein the flexible tongue is of an elongated shape with a length in the longitudinal direction, wherein the flexible tongue comprises in an uncompressed state a tongue uncompressed width, wherein the flexible tongue comprises in the compressed state a tongue compressed width, wherein a spring travel distance is the difference between the tongue uncompressed width and the compressed tongue width, wherein a ratio between the length of the tongue and the spring travel distance is in the range of about 5 to about 30, such as about 10 to about 20, such as about 12 to about 18, such as about 15.

A fourth aspect comprises the set according to the first aspect and the tongue according to the second or third aspect.

The first panel and the second panel may be resilient panels. The resilient panels may comprise a core comprising a polymer material, such as a thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The first panel and the second panel may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The first panel and the second panel may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

The first and the second panel may comprise a wood-based core, such as HDF, MDF or plywood.

BRIEF DESCRIPTION OF THE DRAWINGS

These and other aspects, features and advantages of which embodiments of the disclosure are capable of, will be apparent and elucidated from the following description of embodiments of the present disclosure, reference being made to the accompanying drawings, in which.

of the tongue according to the invention.

Figure 2A:
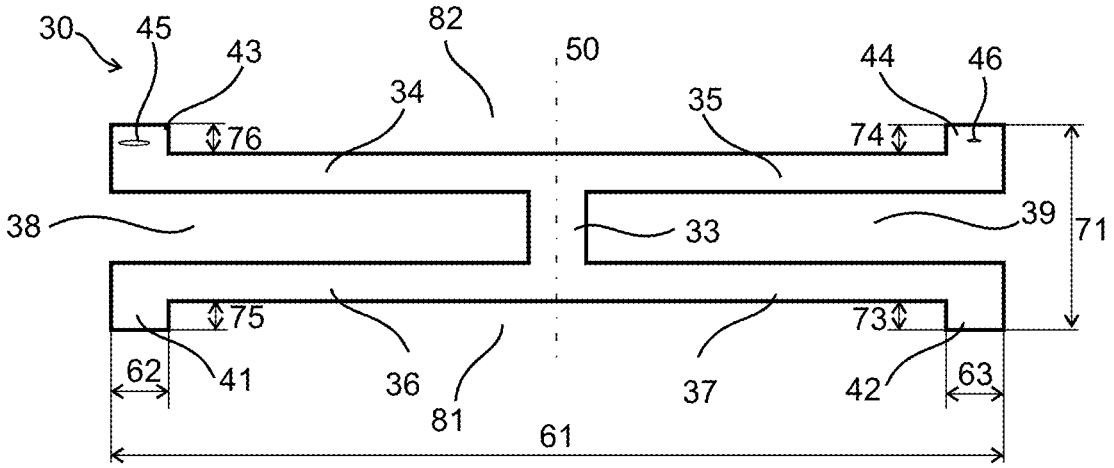
Figure 2B:
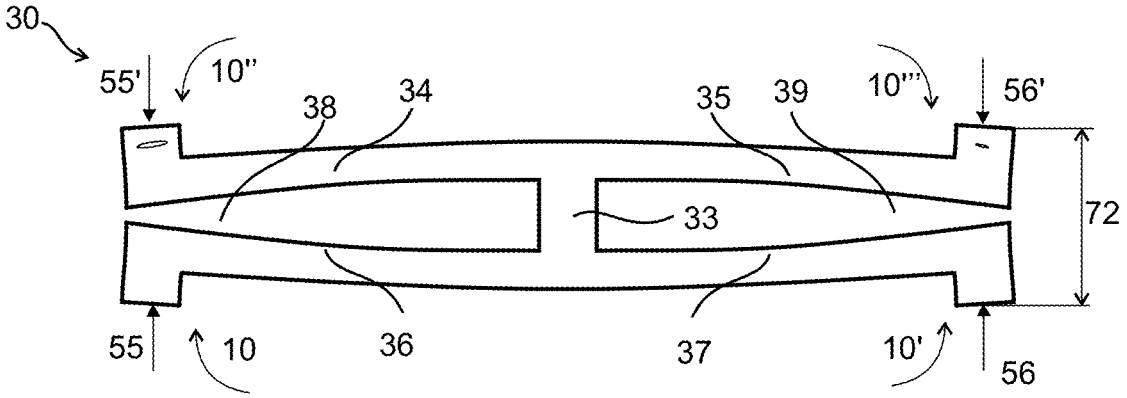

FIGS. 2A-2B show a top view of an embodiment of a tongue according to the invention.

Figure 3A:
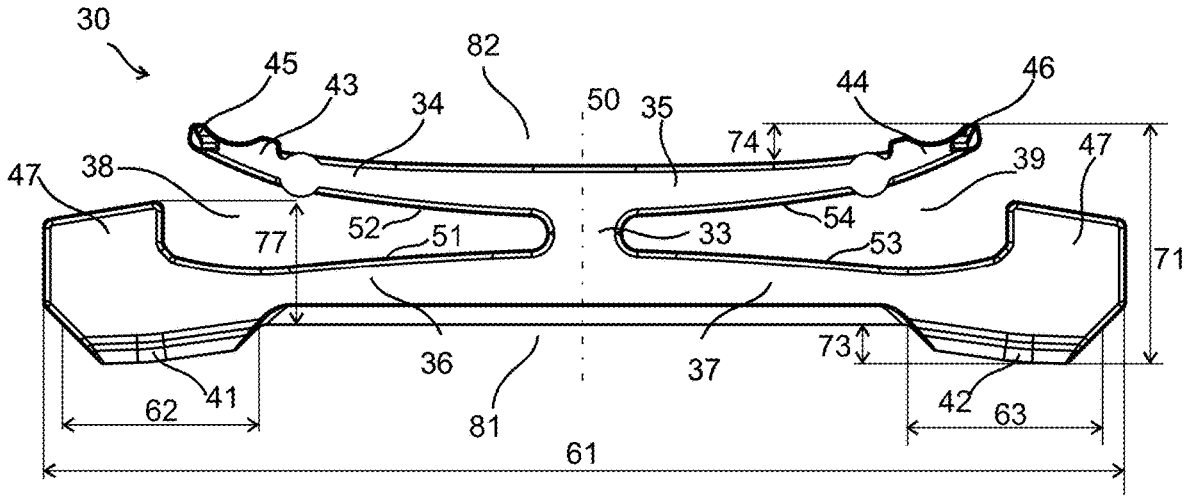
Figure 3B:
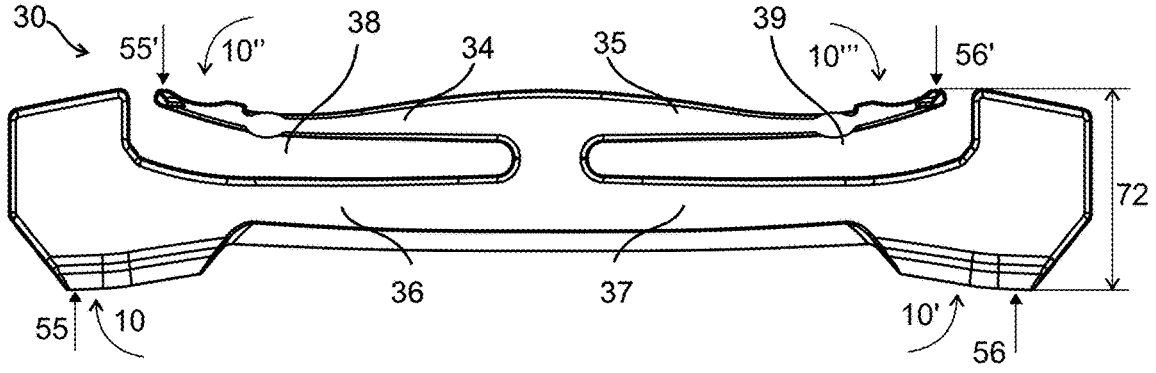

FIGS. 3A-3B show a top view of an embodiment of the tongue according to the invention.

Figure 4A:
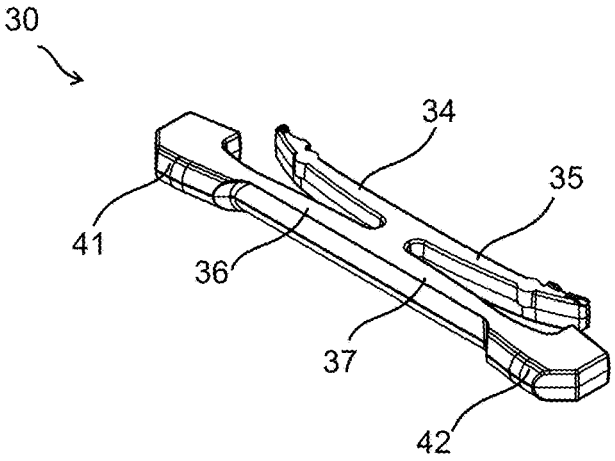

FIG. 4A shows a 3D-view of an embodiment of the tongue according to the invention.

FIGS. 4B-4E show side views of the tongue shown in FIG. 4A

Figure 5A:
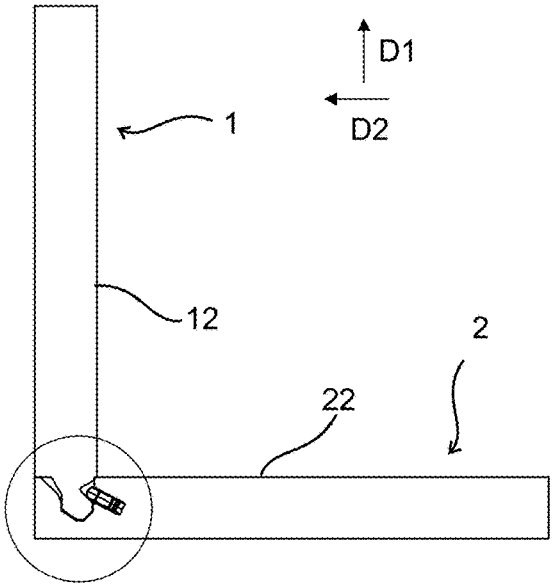

FIG. 5A shows a side view of an embodiment of the set of panels according to the invention.

Figure 5B:
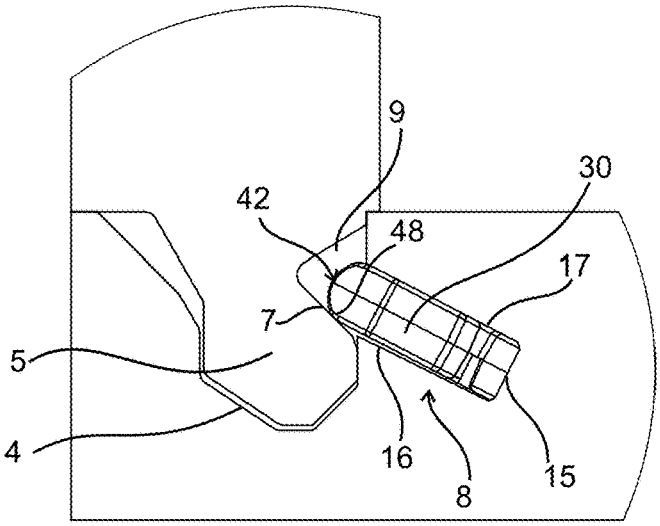

FIG. 5B shows an enlarged part of the encircled are in FIG. 5A.

Figure 5C:
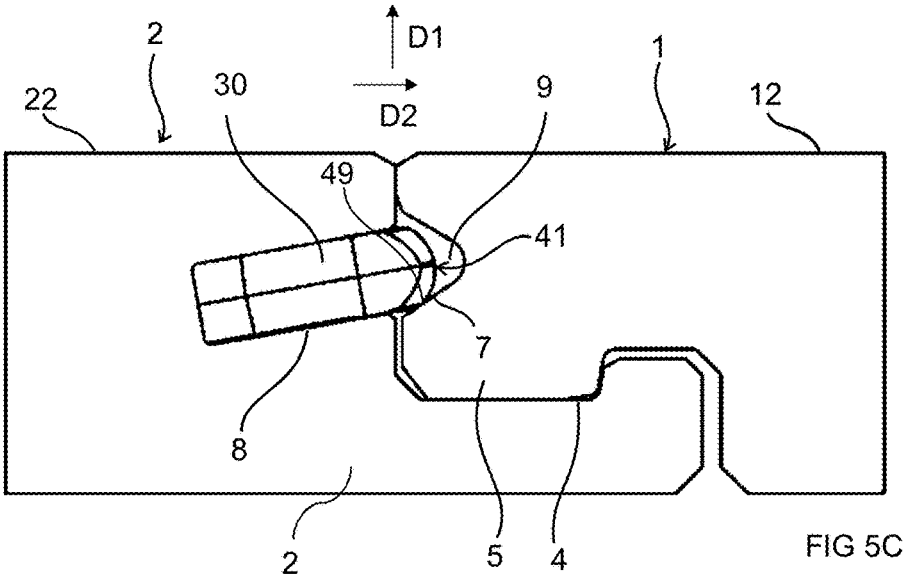

FIG. 5C shows a side view of an embodiment of the set of panels according to the invention.

Figure 6A:
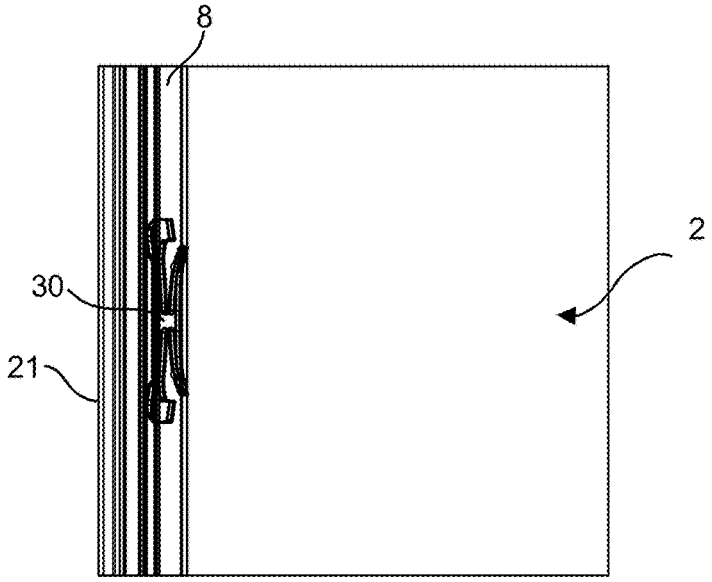

FIG. 6A shows a top view of an embodiment of a panels according to the invention.

Figure 6B:
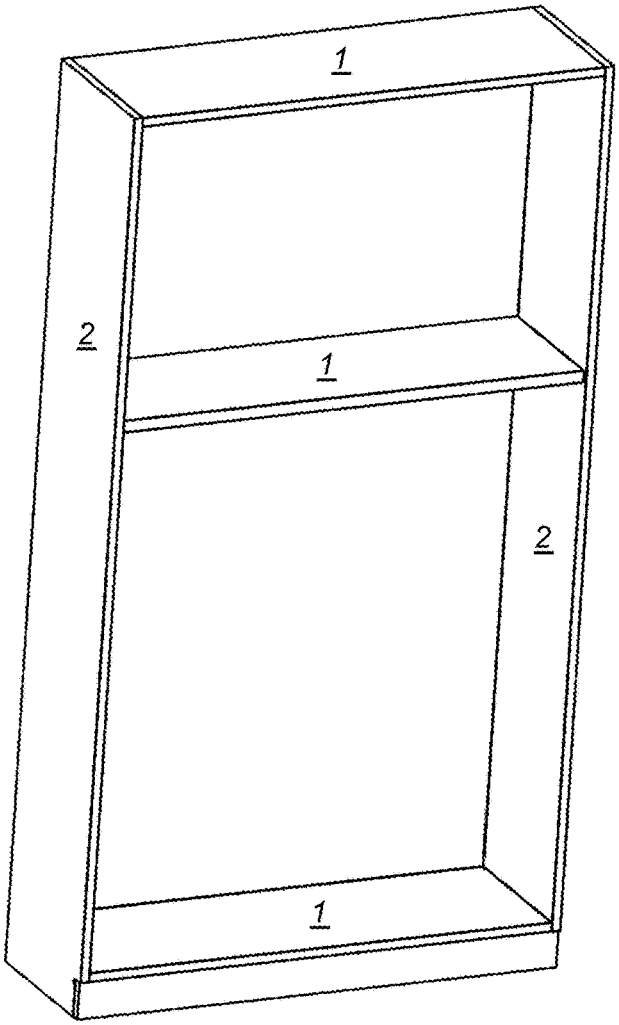

FIG. 6B shows 3D-view of an embodiment of an assembled furniture component according to of the invention.

DETAILED DESCRIPTION

Specific embodiments of the disclosure will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the invention. In the drawings, like numbers refer to like elements.

Figure 1:
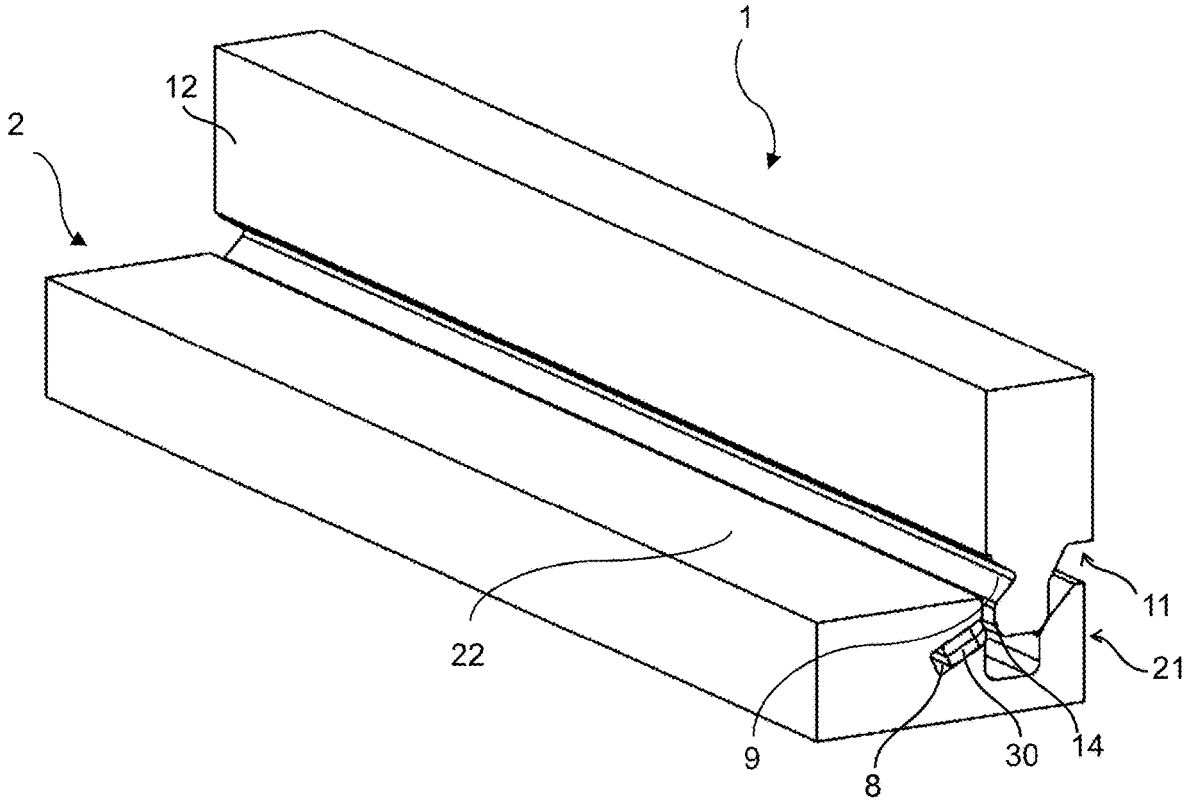
FIG. 1 shows a 3D-view of an embodiment of a set of panels according to the invention.

FIG. 1 shows a 3D-view of an embodiment of a set of panels, such as building panels, which comprises a first panel 1 with a first edge 11 and a second panel 2 with a second edge 21 and a flexible tongue 30, wherein the second edge 21 comprises an insertion groove 8 comprising the flexible tongue 30 and the first edge 11 comprises a tongue groove 9, wherein the flexible tongue 30 is configured to cooperate in an assembled state of the first panel 1 and the second panel 2 with the tongue groove 9.

FIGS. 2A-4E shows embodiments of the flexible tongue 30 which comprises a flexible element 36 and an opposite flexible element 37, wherein an end of the flexible element 36 and an end of the opposite flexible element 37 are connected to a connecting part 33, wherein an outer end of the flexible element 36 and an outer end of the opposite flexible element 37 each comprises a protruding part 41, 42.

The protruding part 41 of the flexible element 36 and the protruding part 42 of the opposite flexible element 37 may be configured to cooperate during assembling of the first panel 1 and the second panel 2 with a guiding surface 14 of the first panel such that the protruding part 41 of the flexible element 36 and the protruding part 42 of the opposite flexible element 37 are pushed towards a bottom surface 15 of the insertion groove 9.

The flexible element 36 may be bendable 10 towards the bottom surface 15 of the insertion groove 9 when a force 55 is applied against the protruding part 41 of the flexible element 36.

The flexible element 36 may be configured to spring back when the force 55 is removed.

The opposite flexible element 37 may bendable 10' towards the bottom surface 15 of the insertion groove 9 when a force 56 is applied against the protruding part 42 of the opposite flexible element 37.

The opposite flexible element 37 may be configured to spring back when the force 56 is removed.

The protruding part 41 of the flexible element 36 and the protruding part 42 of the opposite flexible element 37 may be configured to cooperate in the assembled state with the tongue groove 9.

The protruding part 41 of the flexible element 36 may protrude from the flexible element 36 in a direction away from the bottom surface 15 of the insertion groove 9.

The protruding part 42 of the opposite flexible element 37 may protrude from the opposite flexible element 37 in a direction away from the bottom surface 15 of the insertion groove 9.

The flexible tongue may comprise a longitudinal space 81 between the protruding part 41 of the flexible element 36 and the protruding part 42 of the opposite flexible element 37.

The flexible element 36 and the opposite flexible element 37 are configured to bend 10, 10' during the assembling.

The protruding part 41 of the flexible element 36 and the protruding part 42 of the opposite flexible element 37 may be configured to before the assembling to protrude outside the insertion groove 8.

The flexible tongue 30 may comprise an inner flexible element 34 and an opposite inner flexible element 35, wherein an end of the inner flexible element 34 and an end of the opposite inner flexible element 35 may be connected to the connecting part 33.

The inner flexible element 34 may be positioned between the flexible element 36 and the bottom surface 15 of the insertion groove 9.

The opposite inner flexible element 35 may be positioned between the opposite flexible element 37 and the bottom surface 15 of the insertion groove 9.

The inner flexible element 34 and/or the opposite inner flexible element 35 and the connecting part 33 may be configured to be positioned within the insertion groove 8.

An outer end of the inner flexible element 34, and an outer end of the opposite inner flexible element 35 may each comprises a protruding part 43, 44 which may be configured to cooperate during the assembling with a bottom surface of the insertion groove 8.

The protruding part 43 of the inner flexible element 34 may protrude from the inner flexible element 34 towards the bottom surface 15 of the insertion groove 9.

The protruding part 44 of the opposite inner flexible element 35 may protrude from the opposite inner flexible element 35 towards the bottom surface 15 of the insertion groove 9.

The flexible tongue may comprise a space 82 between protruding part 43 of the inner flexible element 34 and the protruding part 44 of the opposite inner flexible element 35.

The flexible tongue may comprise a space 38 between the flexible element 36 and the inner flexible element 34, and an opposite space 39 between the opposite flexible element 37 and the opposite inner flexible element 35.

The flexible element 36 and the inner flexible element 34 may during the assembling be configured to bend 10, 10" towards each other, and the opposite flexible element 37 and the opposite inner flexible element 35 may be configured to bend 10', 10'" towards each other, optionally such that the space 38 and the opposite space 39 decrease.

The bending of the flexible elements during assembling and/or a correct position of the flexible tongue before assembling and in the assembled state may be detected by a CT scanner.

A longitudinal direction of the tongue 30 may be essentially parallel with a longitudinal direction of the insertion groove 8.

The flexible tongue may have a symmetrical shape with a symmetry line 50 through the connecting part 33.

The inner flexible element 34 may comprises a first friction connection 45 and/or the opposite inner flexible element 35 may comprise a second friction 46 connection which may secure the flexible tongue in the correct position during, e.g., transportation or assembling of the panels.

The first friction connection 45 may be larger than the second friction connection 46, such that a larger friction force is obtained at the first friction connection 45 compared to the friction force at the second friction connection 46. An advantage may be that a length of the flexible tongue may increase during compression, such as during the assembling, and an end of the flexible tongue with the second friction connection 46 may be displaced.

FIG. 2A shows a top view of an embodiments of the tongue in an uncompressed state and FIG. 2B shows the embodiments a compressed state.

FIG. 3A shows a top view of an embodiments of the tongue in an uncompressed state and FIG. 3B shows the embodiments a compressed state.

FIGS. 2B and 3B show that the flexible element 36 and the inner flexible element 34 may be configured to bend 10, 10''' towards each other when a force 55 is applied against the protruding part 41 of the flexible element 36 and a force 55' is applied against the protruding part 43 at the inner flexible element 34.

The opposite flexible element 37 and the opposite inner flexible element 35, may be configured to bend 10', 10'' towards each other when a force 56 is applied against the protruding part 42 of the opposite flexible element 37 and a force 56' is applied against the protruding part 44 at the opposite inner flexible element 35.

These forces may correspond to forces which are applied on the flexible tongue 30 during the assembling with the effect that the flexible tongue 30 may be compressed against a bottom surface of the insertion groove.

The flexible element 36 may have a spring constant in the range of about 5 N/mm to about 80 N/mm, such as about 10 N/mm to about 60 N/mm, such as about 10 N/mm to about 40 N/mm, or about 20 N/mm.

The opposite flexible element 37 may have a spring constant in the range of about 5 N/mm to about 80 N/mm, such as about 10 N/mm to about 60 N/mm, such as about 10 N/mm to about 40 N/mm, or about 20 N/mm.

The inner flexible element 34 may have a spring constant in the range of about 1 N/mm to about 40 N/mm, such as about 5 N/mm to about 20 N/mm, or about 10 N/mm.

The opposite inner flexible element 35 may have a spring constant in the range of about 1 N/mm to about 40 N/mm, such as about 5 N/mm to about 20 N/mm, or about 10 N/mm.

The inner flexible element 34 may have a lower spring constant than the flexible element 36.

The spring constant of the inner flexible element 34 may be at least 10% lower, such as at least 25% lower, such as at least 50% lower, such as at least 75% lower than the spring constant of the flexible element 36.

The opposite inner flexible element 35 may have a lower spring constant than the opposite flexible element 37.

The spring constant of the opposite inner flexible element 35 may be at least 10% lower, such as at least 25% lower, such as at least 50% lower, such as at least 75% lower than the spring constant of the opposite flexible element 37.

This may have the effect that mainly the inner flexible element 34 and the opposite inner flexible element 35 are bent during an initial stage of the compression. The flexible element 36 and the opposite flexible element 37 may bend at a later stage when the inner flexible element 34 and the opposite inner flexible element 35 may have reached its maximum bending.

An advantage may be that a progressive spring force may be obtained which may facilitate assembling and locking together objects, such as panels, since the required force for compression of the tongue is initially lower when the object may have an unstable guiding.

FIGS. 2A and 3A show that the flexible tongue may be of an elongated shape with a length 61.

The flexible tongue may be injection moulded. Thus, the entire flexible tongue may be made from the same material.

The flexible tongue may comprise a polymer material, such as a thermoplastic material, optionally with an enforcement, such as glass fibre.

The flexible tongue may, in the uncompressed state, have a tongue uncompressed width 71. The width of the tongue in the uncompressed state may be in the range of about 6 mm to about 12 mm, such as about 8 mm to about 10 mm, such as about 9 mm.

The length 61 of the flexible tongue may be in a range of about 20 mm to about 70 mm, such as about 30 mm to about 50 mm, such as about 40 mm.

The flexible tongue may in the compressed state comprise a compressed tongue width 72, see FIGS. 2B and 3B, wherein a ratio between the uncompressed tongue width 71 and the compressed tongue width 72 is within the range of 1.1-2, such as 1.5.

A spring travel distance may be the difference between the uncompressed tongue width 71 and the compressed tongue width 72. The spring travel distance may be in the range of about 0.5 mm to about 10 mm, such as about 1 mm to about 8 mm, such as about 2 mm to about 5 mm.

The flexible tongue may, in the compressed state, have tongue a compressed width 72. The width 72 of the tongue in the compressed state may be in the range of about 3 mm to about 9 mm, such as about 5 mm to about 7 mm, such as about 6 mm.

A ratio between the length of the tongue 61 and the spring travel distance may be in the range of about 5 to about 30, such as about 10 to about 20, such as about 12 to about 18, such as about 15.

The protruding part 41 at the flexible element 36 may protrude at a distance 75 from the flexible element 36. The protruding distance 75 may be in the range of about 0.5 mm to about 3 mm, such as about 1 mm to about 2 mm, such as about 1.5 mm.

The protruding part 41 of the flexible element 36 may comprise a width 62, wherein the width 62 is in the range 10-30%, such as 15-25%, such as about 20% of the length of the tongue 61.

The protruding part 42 at the opposite flexible element 37 may protrude at a distance 73 from the opposite flexible element 37. The protruding distance 73 may be in the range of about 0.5 mm to about 3 mm, such as about 1 mm to about 2 mm, such as about 1.5 mm.

The protruding part 42 of the opposite flexible element 37 may comprise a width 63, wherein the width 63 is in the range 10-30%, such as 15-25%, such as about 20% of the length of the tongue.

The protruding part 43 at the inner flexible element 34 may protrude at a distance 76 from the inner flexible element 34. The protruding distance 76 may be in the range of about 0.5 mm to about 3 mm, such as about 1 mm to about 2 mm, such as about 1.3 mm.

The protruding part 44 at the opposite inner flexible element 35 may protrude at a distance 74 from the opposite inner flexible element 35. The protruding distance 74 may be in the range of about 0.5 mm to about 3 mm, such as about 1 mm to about 2 mm, such as about 1.3 mm.

FIGS. 3A and 3B shows that an inner surface of the flexible element 36 may comprise a convex surface 51 which faces the inner flexible element 34.

An inner surface of the opposite flexible element 37 may comprise a convex surface 53 which faces the inner opposite flexible element 34.

An inner surface of the inner flexible element 34 may comprise a convex surface 52 which faces the flexible element 36.

An inner surface of the opposite inner flexible element 35 may comprise a convex surface 54 which faces the opposite flexible element 37.

The convex surfaces may have the effect that the bending strength of the flexible elements is increased.

The end of flexible element 36 and the end of the opposite flexible element 37 may each comprise an inwardly protruding element 47. The inwardly protruding elements 47 may be configured to cooperate with the insertion groove 8 during the assembling to counteract the flexible element 36 and the opposite flexible element 37 from rotating, such as twisting, when the flexible tongue is compressed.

Figure 4B:
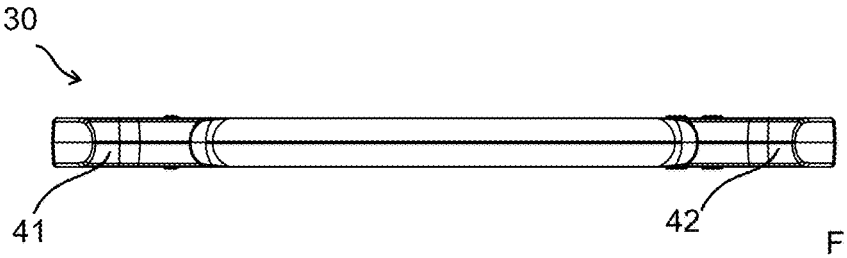
Figure 4C:
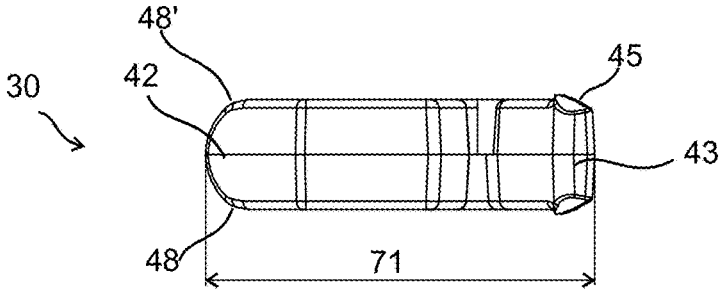

A distance 77 from an outer edge of the flexible element 36 and the opposite flexible element, respectively, and the innermost edge of the inwardly protruding element 47 may be in the range of about 2 mm to about 6, such as about 3 mm to about 5 mm, such as about 4 mm FIG. 4A shows a 3D-view of an embodiment of the flexible tongue 30. FIG. 4B to 4C shows different sideview of the same embodiment in an uncompressed state and FIG. 4E shows the same embodiment in a compressed state.

Figure 4D:
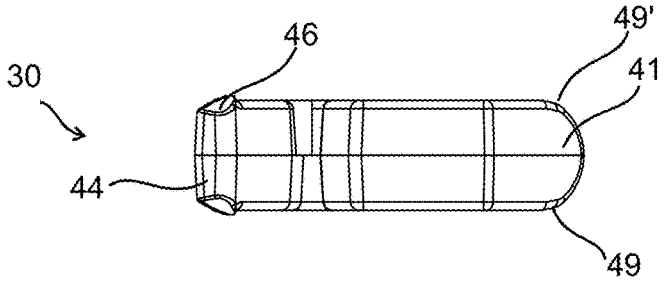
Figure 4E:
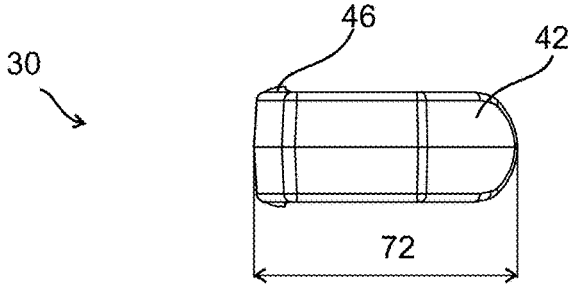

FIGS. 4C and 4D show that the protruding part 41 of the flexible element 36 and the protruding part 42 opposite flexible element 37 may each comprise a locking surface 48, 49 and an opposite locking surface 48', 49' which may each be configured to cooperate with a locking surface 7 of the tongue groove 9. This may have the effect that the flexible tongue 30 may be inserted in the insertion groove 8 in two different orientation with the same locking function.

FIG. 5A shows a side view of an embodiment of the set of panels in as assembled state. The first panel 1 may be assembled perpendicular to the second panel 2. A first main surface 12 of the first panel is perpendicular to a second main surface 22 of the second panel 2.

FIG. 5B shows an enlarged part of the encircled are in FIG. 5A. The insertion groove 8 may comprise a lower surface 16 and an upper surface 17 and a bottom surface 15 which is extending between the lower surface 16 and the upper surface 17. An embodiment of the flexible tongue 30 is positioned in the insertion groove 8.

A locking surface 48 of the flexible tongue 30 is cooperating with a locking surface 7 of a tongue groove 9 of the first panel for locking the first panel and the second panel together in a first direction D1. The first panel comprises an edge tongue 5 which cooperates with a panel groove 4 of the second panel for locking the first panel 1 and the second panel 2 together in a second direction D2 which is perpendicular to the first direction.

FIG. 5C shows a side view of an embodiment of the set of panels in as assembled state. The first panel 1 may be assembled parallel to the second panel 2. A first main surface 12 of the first panel is parallel to a second main surface 22 of the second panel 2. An embodiment of the flexible tongue 30 is positioned in the insertion groove 8.

A locking surface 49 of the flexible tongue 30 is cooperating with a locking surface 7 of a tongue groove 9 of the first panel for locking the first panel and the second panel together in a first direction D1. The first panel comprises an edge tongue 5 which cooperates with a panel groove 4 of the second panel for locking the first panel 1 and the second panel 2 together in a second direction D2 which is perpendicular to the first direction.

FIG. 6A shows a top view of an embodiment of the second panel 2 comprising an embodiment of the flexible tongue positioned in an embodiment of the insertion groove 8. A longitudinal direction of the tongue 30 may be essentially parallel with a longitudinal direction of the insertion groove 8 and a longitudinal direction of the insertion groove 8 may be essentially parallel with the second edge 21 of the second panel.

FIG. 6B shows 3D-view of an embodiment of an assembled furniture component comprising embodiments of the first panel 1 and the second panel 2.

Further embodiments of the invention are described below:

1. A flexible tongue 30 which is configured to lock a first edge of a first panel 1 to a second edge of a second panel 2 wherein the flexible tongue 30 is configured to be positioned in an insertion groove 8 at the second edge of the second panel 2 and to cooperate with a tongue groove 20 at the first edge of the first panel 1, wherein the flexible tongue 30 comprises a flexible element 36 and an opposite flexible element 37, wherein an end of the flexible element 36 and an end of the opposite flexible element 37 are connected to a connecting part 33, wherein an outer end of the flexible element 36 and an outer end of the opposite flexible element 37 each comprises a protruding part 41, 42, wherein the flexible tongue 30 comprises an inner flexible element 34 and an opposite inner flexible element 35, wherein an end of the inner flexible element 36 and an end of the opposite inner flexible element 37 are connected to the connecting part 33, wherein an outer end of the inner flexible element 34, and an outer end of the opposite inner flexible element 35 each comprises a protruding part 43, 44 which are during the assembling configured to cooperate with a bottom surface of the insertion groove 8, wherein the flexible element 36 and the inner flexible element 34 are configured to bend towards each other when a force 55 is applied against the protruding part 41 of the flexible element 36, wherein the opposite flexible element 37 and the opposite inner flexible element 35, are configured to bend towards each other when a force 56 is applied against the protruding part 42 of the opposite flexible element 37, such that the flexible tongue is compressed against a bottom surface of the insertion groove.

2. The flexible tongue 30 as described in embodiment 1, wherein the protruding part 41 of the flexible element 36 and the protruding part 42 of the opposite flexible element 37 are configured to protrude outside the insertion groove 8 before the flexible element 36 is compressed.

3. The flexible tongue 30 as described in embodiments 1 or 2, wherein the inner flexible element 34, the opposite inner flexible element 35 and the connecting part 33 are configured to be positioned within the insertion groove 8.

4. The flexible tongue 30 as described in any one of embodiments 1-3, wherein the protruding part 43 of the inner flexible element 34 and the protruding part 44 of the opposite inner flexible element 34 are configured to cooperate during the compression with a bottom surface of the insertion groove 8.

5. The flexible tongue 30 as described in any one of embodiments 1-4, wherein the protruding part 41 of the flexible element 36 and the protruding part 42 of the opposite flexible element 37 are configured to cooperate in the assembled state with the tongue groove 9.

6. The flexible tongue 30 as described in any one of embodiments 1-5, wherein the flexible tongue comprises a space 38 between the flexible element 36 and the inner flexible element 34, and an opposite space 39 between the opposite flexible element 37 and the opposite inner flexible element 35.

7. The flexible tongue 30 as described in embodiment 6, wherein the flexible tongue 30 is configured such that during the compression the space 38 and the opposite space 39 decreases.

8. The flexible tongue 30 as described in any one of the embodiments 1-7, wherein a longitudinal direction of the tongue 30 is essentially parallel with a longitudinal direction of the insertion groove 8.

9. The flexible tongue 30 as described in any one of the embodiments 1-8, wherein the flexible tongue has a symmetrical shape with a symmetry line 50 through the connecting part 33.

10. The flexible tongue 30 as described in any one of the embodiments 1-9, wherein the flexible tongue is of an elongated shape with a length 61.

11. The flexible tongue 30 as described in any one of the embodiments 1-10, wherein the flexible tongue comprises in an uncompressed state an uncompressed tongue width 71.

12. The flexible tongue 30 as described in embodiment 11, wherein the flexible tongue comprises in the compressed state a compressed tongue width 72, wherein a ratio between the uncompressed tongue width 71 and the compressed tongue width 72 is within the range of 1.1-2, such as 1.5

13. The flexible tongue 30 as described in any one of the embodiments 1-12, wherein the protruding part 41 at the flexible element 36 protrudes at a distance 75 from the flexible element 36.

14. The flexible tongue 30 as described in embodiments 13, wherein the protruding part 41 of the flexible element 36 comprises a width 62, wherein the width 62 is in the range 10-30%, such as 15-25%, such as about 20% of the length of the tongue.

15. The flexible tongue 30 as described in any one of the embodiments 1-12, wherein the protruding part 42 at the opposite flexible element 37 protrudes at a distance 73 from the opposite flexible element 37.

16. The flexible tongue 30 as described in embodiments 15, wherein the protruding part 42 of the opposite flexible element 37 comprises a width 63, wherein the width 63 is in the range 10-30%, such as 15-25%, such as about 20% of the length of the tongue.

17. The flexible tongue 30 as described in any one of the embodiments 1-16, wherein the protruding part 43 at the inner flexible element 34 protrudes at a distance 76 from the inner flexible element 34.

18. The flexible tongue 30 as described in any one of the embodiments 1-17, wherein the protruding part 44 at the opposite inner flexible element 35 protrudes at a distance 74 from the opposite inner flexible element 35.

19. The flexible tongue 30 as described in any one of the embodiments 1-18, wherein an inner surface of the flexible element 36 comprises a convex surface 51 which faces the inner flexible element 34.

20. The flexible tongue 30 as described in any one of the embodiments 1-19, wherein an inner surface of the opposite flexible element 37 comprises a convex surface 53 which faces the inner opposite flexible element 34.

21. The flexible tongue 30 as described in any one of the embodiments 1-20, wherein an inner surface of the inner flexible element 34 comprises a convex surface 52 which faces the flexible element 36.

20. The flexible tongue 30 as described in any one of the embodiments 1-19, wherein an inner surface of the opposite inner flexible element 35 comprises a convex surface 54 which faces the opposite flexible element 37.

21. The flexible tongue 30 as described in any one of the embodiments 1-20, wherein the inner flexible element 34 comprises a first friction connection 45 and/or the opposite inner flexible element 35 comprises a second friction 46 connection.

22. The flexible tongue 30 as described in embodiment 21, wherein the first friction connection 45 is larger than the second friction connection 46, such that a larger friction force is obtained at the first friction connection 45 compared to the friction force at the second friction connection 46.

23. The flexible tongue 30 as described in any one of the embodiments 1-22, wherein the flexible tongue comprises a polymer material, such as a thermoplastic material, optionally with an enforcement, such as glass fibre.

24. The flexible tongue 30 as described in any one of the embodiments 1-23, wherein the flexible tongue is injection moulded.

25. The flexible tongue 30 as described in any one of the embodiments 1-24, wherein the entire flexible tongue is made from the same material.

26. The flexible tongue 30 as described in any one of the embodiments 1-25, wherein the flexible tongue is of an elongated shape with a length 61, wherein the flexible tongue comprises in an uncompressed state a tongue uncompressed width 71, wherein the flexible tongue comprises in the compressed state a tongue compressed width 72, wherein a spring travel distance is the difference between the tongue uncompressed width 71 and the compressed tongue width 72, and wherein a ratio between the length of the tongue 61 and the spring travel distance is in the range of about 5 to about 30, such as about 10 to about 20, such as about 12 to about 18, such as about 15.

27. The flexible tongue 30 as described in any one of the embodiments 1-26, wherein the flexible tongue is of an elongated shape with a length 61, wherein the length 61 of the flexible tongue is in a range of about 20 mm to about 70 mm, such as about 30 mm to about 50 mm, such as about 40 mm.

28. The flexible tongue 30 as described in any one of the embodiments 1-27, wherein the protruding part 41 of the flexible element 36 protrudes from the flexible element 36 in a direction away from the bottom surface 15 of the insertion groove 9.

29. The flexible tongue 30 as described in any one of the embodiments 1-28, wherein the protruding part 42 of the opposite flexible element 37 protrudes from the opposite flexible element 37 in a direction away from the bottom surface 15 of the insertion groove 9.

30. The flexible tongue 30 as described in any one of the embodiments 1-29, wherein the flexible tongue comprises a longitudinal space 81 between the protruding part 41 of the flexible element 36 and the protruding part 42 of the opposite flexible element 37.

31. A set of panels, such as building panels, which comprises a first panel 1 with a first edge 11 and a second panel 2 with a second edge 21 and a flexible tongue 30, wherein the second edge 21 comprises an insertion groove 8 comprising the flexible tongue 30 and the first edge 11 comprises a tongue groove 9, wherein the flexible tongue 30 is configured to cooperate in an assembled state of the first panel 1 and the second panel 2 with the tongue groove 9, wherein the flexible tongue 30 comprises a flexible element 36 and an opposite flexible element 37, wherein an end of the flexible element 36 and an end of the opposite flexible element 37 are connected to a connecting part 33, wherein an outer end of the flexible element 36 and an outer end of the opposite flexible element 37 each comprises a protruding part 41, 42, wherein the protruding part 41 of the flexible element 36 and the protruding part 42 of the opposite flexible element 37 are configured to cooperate during assembling of the first panel 1 and the second panel 2 with a guiding surface 14 of the first panel 1 such that the protruding part 41 of the flexible element 36 and the protruding part 42 of the opposite flexible element 37 are pushed towards a bottom surface 15 of the insertion groove 9, and wherein the protruding part 41 of the flexible element 36 and the protruding part 42 of the opposite flexible element 37 are configured to cooperate in the assembled state with the tongue groove 9.

32. The set as described in embodiment 31, wherein the flexible element 36 and the opposite flexible element 37 are configured to bend during the assembling.

33. The set as described in embodiment 31 or 32, wherein the protruding part 41 of the flexible element 36 and the protruding part 42 of the opposite flexible element 37 are configured to before the assembling protrude outside the insertion groove 8.

34. The set as described in any one of the embodiments 31-33, wherein flexible tongue 30 comprises an inner flexible element 34 and an opposite inner flexible element 35, wherein an end of the inner flexible element 34 and an end of the opposite inner flexible element 35 are connected to the connecting part 33.

35. The set as described in embodiments 34, wherein inner flexible element 34, the opposite inner flexible element 35 and the connecting part 33 are configured to be positioned within the insertion groove 8.

36. The set as described in embodiments 34 or 35, wherein an outer end of the inner flexible element 34, and an outer end of the opposite inner flexible element 35 each comprises a protruding part 43, 44 which are configured to cooperate during the assembling with a bottom surface of the insertion groove 8.

37. The set as described in any one of the embodiments 34-36, wherein the flexible tongue comprises a space 38 between the flexible element 36 and the inner flexible element 34, and an opposite space 39 between the opposite flexible element 37 and the opposite inner flexible element 35.

38. The set as described in any one of the embodiments 34-37, wherein the flexible element 36 and the inner flexible element 34 are during the assembling configured to bend towards each other, and the opposite flexible element 37 and the opposite inner flexible element 35 are configured to bend towards each other, optionally such that the space 38 and the opposite space 39 decreases.

39. The set of panels as described in any one of the embodiments 31-38, wherein a longitudinal direction of the tongue 30 is essentially parallel with a longitudinal direction of the insertion groove 8.

40. The set of panels as described in any one of the embodiments 31-39, wherein the flexible tongue has a symmetrical shape with a symmetry line 50 through the connecting part 33.

Although the present inventive concept has been described and illustrated in detail, it is clearly understood that the same is by way of illustration and example only and is not to be taken by way of limitation, the spirit and scope of the present inventive concept being limited only by the terms of the appended claims.

The invention claimed is:

1. A set of panels comprising a first panel with a first edge and a second panel with a second edge and a flexible tongue, wherein the second edge comprises an insertion groove comprising the flexible tongue and a bottom surface and the first edge comprises a tongue groove, wherein the flexible tongue is configured to cooperate in an assembled state of the first panel and the second panel with the tongue groove, wherein the flexible tongue comprises a flexible element and an opposite flexible element, wherein an end of the flexible element and an end of the opposite flexible element are connected to a connecting part, wherein an outer end of the flexible element and an outer end of the opposite flexible element each comprise a protruding part, wherein the protruding part of the flexible element protrudes from the flexible element in a direction away from the bottom surface of the insertion groove, wherein the protruding part of the opposite flexible element protrudes from the opposite flexible element in a direction away from the bottom surface of the insertion groove, wherein the flexible tongue comprises a longitudinal space between the protruding part of the flexible element and the protruding part of the opposite flexible element, wherein the protruding part of the flexible element and the protruding part of the opposite flexible element are configured to cooperate during assembling of the first panel and the second panel with a guiding surface of the first panel such that each of the flexible element and the opposite flexible element bends and such that the protruding part of the flexible element and the protruding part of the opposite flexible element are pushed towards the bottom surface of the insertion groove, wherein each of the flexible element and the opposite flexible element springs back in a direction towards the tongue groove when the first panel and the second panel reach the assembled state, wherein the protruding part of the flexible element and the protruding part of the opposite flexible element are configured to cooperate in the assembled state with the tongue groove.

2. The set as claimed in claim 1, wherein, in an unassembled state, the protruding part of the flexible element and the protruding part of the opposite flexible element protrude outside the insertion groove.

3. The set as claimed in claim 1, wherein the flexible tongue comprises an inner flexible element and an opposite inner flexible element, wherein an end of the inner flexible element and an end of the opposite inner flexible element are connected to the connecting part.

4. The set as claimed in claim 3, wherein the inner flexible element is positioned between the flexible element and the bottom surface of the insertion groove, and wherein the opposite inner flexible element is positioned between the opposite flexible element and the bottom surface of the insertion groove.

5. The set as claimed in claim 4, wherein an outer end of the inner flexible element, and an outer end of the opposite inner flexible element each comprises a protruding part which protrudes in a direction towards the bottom surface of the insertion groove.

6. The set as claimed in claim 5, wherein the protruding part of the inner flexible element and the protruding part of the opposite inner flexible element are configured to cooperate during the assembling with the bottom surface of the insertion groove.

7. The set as claimed in claim 5, wherein the flexible tongue comprises a space between the protruding part of the inner flexible element and the protruding part of the opposite inner flexible element.

8. The set as claimed in claim 3, wherein the inner flexible element, the opposite inner flexible element and the connecting part are configured to be positioned within the insertion groove in an unassembled state.

9. The set as claimed in claim 3, wherein the flexible tongue comprises a space between the flexible element and the inner flexible element, and an opposite space between the opposite flexible element and the opposite inner flexible element.

10. The set as claimed in claim 3, wherein the flexible element and the inner flexible element are during the assembling configured to bend towards each other, and the opposite flexible element and the opposite inner flexible element are configured to bend towards each other, optionally such that the space and the opposite space decreases.

11. The set of panels as claimed in claim 1, wherein a longitudinal direction of the flexible tongue is essentially parallel with a longitudinal direction of the insertion groove.

12. The set of panels as claimed in claim 1, wherein the flexible tongue has a symmetrical shape with a symmetry line through the connecting part.

13. The set of panels as claimed in claim 1, wherein the flexible tongue comprises a polymer material.

14. The set of panels as claimed in claim 1, wherein the flexible tongue is injection moulded.

15. The set of panels as claimed in claim 1, wherein the entire flexible tongue is made of the same material.

16. The set of panels as claimed in claim 1, wherein the flexible tongue comprises a polymer material with an enforcement.

* * * * *